US005964516A

United States Patent [19]

Lai

[11] Patent Number: 5,964,516

[45] Date of Patent: Oct. 12, 1999

[54] NIGHT LIGHT WITH WALL OUTLET SHIELD

[76] Inventor: Li-Chun Lai, 21F-1, No. 33, Min Sheng Rd., Sec. 1, Panchiao City Taipei Hsien, Taiwan

[21] Appl. No.: 08/966,471

[22] Filed: Nov. 7, 1997

[51] Int. Cl.[6] ..... F21V 33/00

[52] U.S. Cl. ..... 362/95; 362/84; 362/226

[58] Field of Search ..... 362/84, 226, 253, 362/95; 439/488, 490, 655, 656, 668

[56] References Cited

U.S. PATENT DOCUMENTS

| | | | |
|---|---|---|---|
| 5,481,442 | 1/1996 | Dickie | 362/95 |
| 5,495,402 | 2/1996 | Houssian | 362/226 |
| 5,544,025 | 8/1996 | Bohlool | 362/95 |
| 5,662,408 | 9/1997 | Marischen | 362/226 |
| 5,779,346 | 7/1998 | Burke | 362/84 |

*Primary Examiner*—Sandra O'Shea
*Assistant Examiner*—Marshall Honeyman
*Attorney, Agent, or Firm*—Bacon & Thomas

[57] ABSTRACT

A night light includes a bottom member on which a receptacle is formed to receive and hold therein an electroluminescent light source. The bottom member has two blade openings through which a pair of conductor blades extend to be adapted to fit into a first set of outlet openings of a wall outlet. The conductor blades are in contact engagement with two contact terminals of the light source to conduct electricity to the light source for generating light. A cover member is mounted to cover the bottom member to hold the light source and the conductor blades therein. The bottom member has an extended section adapted to overlap the wall outlet and having a passage corresponding to and exposing a second set of outlet openings of the wall outlet covered by the extended section of the bottom member. A shied is pivoted to the extended section of the bottom member to be rotatable between a closed position where the shield covers the passage and an open position where the shield is rotated away from the bottom member to expose the passage so as to allow an external plug to connect to the second set outlet openings of the wall outlet through the passage. A securing device is provided to releasably secure the shield in the closed position.

8 Claims, 4 Drawing Sheets

NIGHT LIGHT WITH WALL OUTLET SHIELD

FIELD OF THE INVENTION

The present invention relates to a night light and in particular to a night light incorporating an electro-luminescent light source, having a wall power outlet shield to shield an adjacent set of wall outlet openings.

BACKGROUND OF THE INVENTION

Night lights have been widely used in for example bedrooms and passages for purposes of lighting, indication and decoration. The night lights are almost forever plugged in for example a wall outlet for long term operation so that the power consumption is one of the major concerns. Generally, the night lights use an incandescent lamp as the light source which not only consumes a great amount of power but also generates generally insufficient luminance. Thus, most of the incandescent lamp based night lights, in general, can only be regarded as a decoration device. Further, the conventional night lights comprise a bulky light source which takes a greater space in use so that it cannot be arranged to be very close to the wall or the wall outlet. This makes it easier to be disengaged from the wall outlet upon impacted or contacted.

In addition, since the night light is long-term connected to the wall outlet, dust shielding provided by the night light for the wall outlet may be advantageous in a long term use of the night light. Further, such a shielding function is also helpful in preventing the young children from electrical shock caused by accidentally contacting the conductors of the wall outlet. The shielding function also prevents conductive liquid, such as water, from accidentally getting into the wall outlet openings so as to reduce the damage caused by electrical short-circuiting.

OBJECTS OF THE INVENTION

Therefore, an object of the present invention is to provide a night light incorporating therein an electro-luminescent light source so as to provide a maximum luminance with a given power consumption and reduce the space taken by the night light.

Another object of the present invention is to provide a night light which comprises a shielding member to shield another set of outlet openings of the wall outlet to which the night light is plugged.

A further object of the present invention is to provide a night light which has a flat configuration to allow the night light to be arranged very close to the wall or wall outlet to which the night light is mounted.

To achieve the above objects, in accordance with the present invention, there is provided a night light comprising a bottom member on which a receptacle is formed to receive and hold therein an electro-luminescent light source. The bottom member has two blade openings through which a pair of conductor blades extend to be adapted to fit into a first set of outlet openings of a wall outlet. The conductor blades are in contact engagement with two contact terminals of the light source to conduct electricity to the light source for generating light. A cover member is mounted to cover the bottom member to hold the light source and the conductor blades therein. The bottom member has an extended section adapted to overlap the wall outlet and having a passage corresponding to and exposing a second set of outlet openings of the wall outlet covered by the extended section of the bottom member. A shield is pivoted to the extended section of the bottom member to be rotatable between a closed position where the shield covers the passage and an open position where the shied is rotated away from the bottom member to expose the passage so as to allow an external plug to connect to the second set outlet openings of the wall outlet through the passage. A securing device is provided to releasably secure the shield in the closed position.

BRIEF DESCRIPTION OF THE DRAWINGS

The present invention will be better understood from the following description of a preferred embodiment thereof, which is illustrative and not limitative, with reference to the attached drawings, wherein.

DETAILED DESCRIPTION OF THE PREFERRED EMBODIMENT

Figure 1:
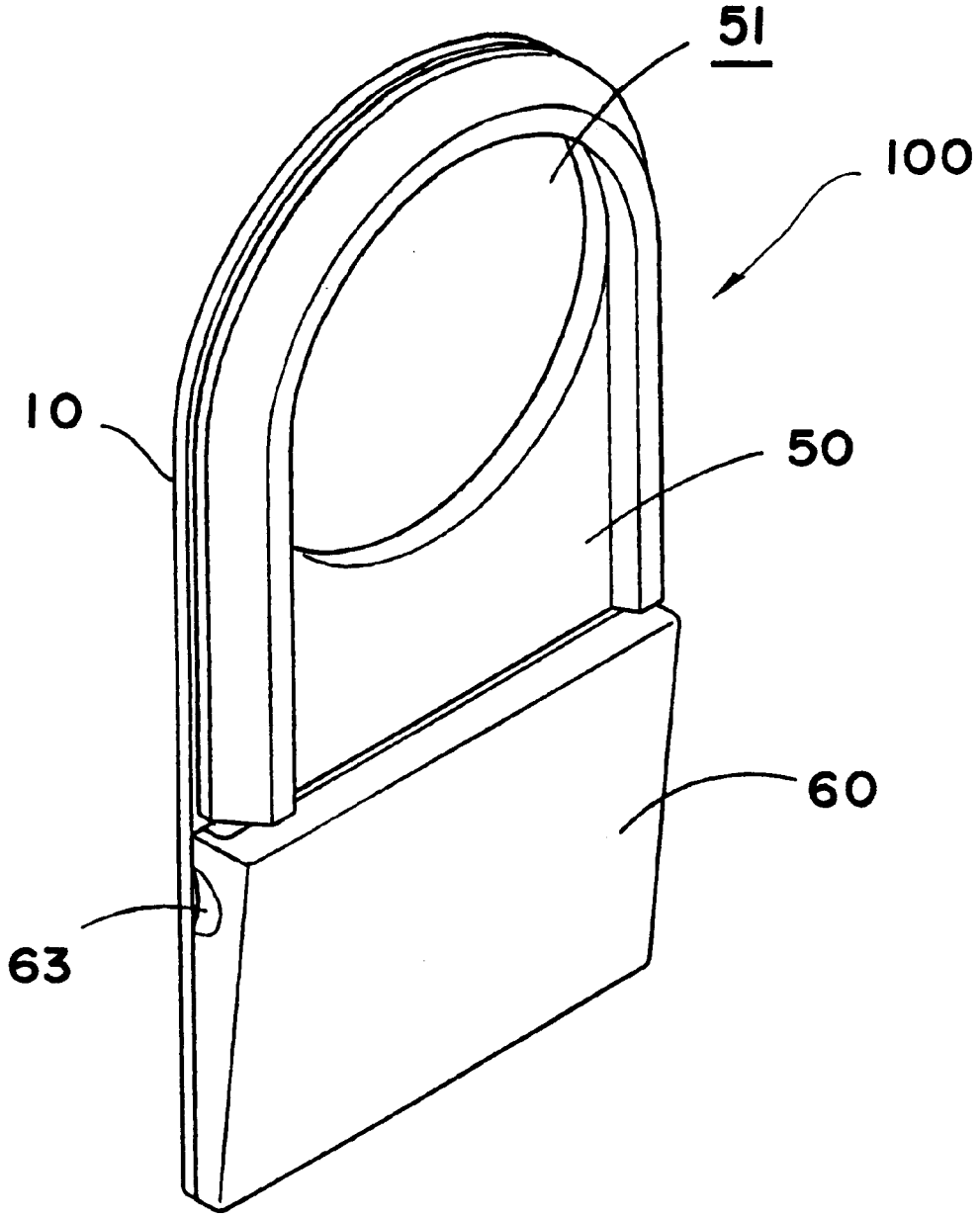
FIG. 1 is a perspective view showing a night light constructed in accordance with the present invention.
Figure 2:
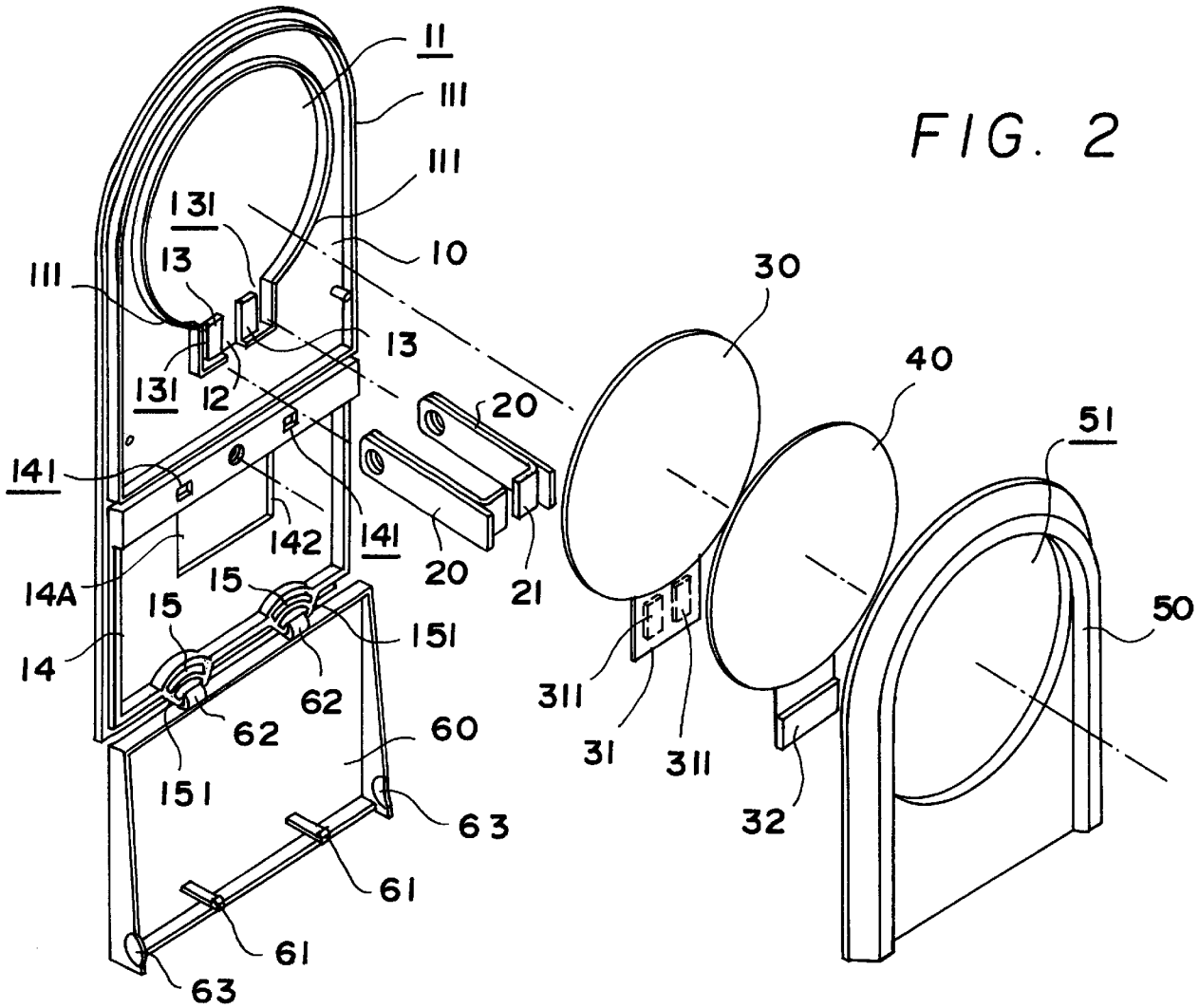
FIG. 2 is a partially exploded perspective view of the night light of the present invention.

With reference to the drawings and in particular to FIGS. 1 and 2, wherein a night light constructed in accordance with the present invention, generally designated at 100, is shown, the night light 100 comprise a bottom or body 10 having a front portion on which a recessed receptacle 11 is formed which may be of any desired shape, but is circular in the embodiment illustrated for demonstration only. The receptacle 11 comprises a circumferential flange or side wall having an inside surface on which a plurality positioning retaining tabs 111 are formed. The tabs 111 may be of any suitable shape, but are triangular in the embodiment illustrated for demonstration only. The receptacle 11 has formed on a rear end side an extension or base section 12 on which two pads 13 are provided each having an blade opening 131 associated therewith and preferable next thereto. The blade openings 131 which extend through the base section 12 of the receptacle 11 receive conductor blades 20 therein to allow the conductor blades 20 to extend therethrough for plugging into a first set of outlet openings (not explicitly shown) provided on a wall outlet 200 (see FIG. 3).

The body 10 has a rear portion defining an extended frame section 14 on which a passage 14A is provided. The passage 14A is positioned to correspond to a second set of the wall outlet 200 (presuming the wall outlet has at least two sets of outlet openings) when the night light 10 is plugged into the first set of outlet openings of the wall outlet 200 so as to allow an external plug (see phantom lines of FIG. 3) to connect to the second set of outlet openings through the passage 14A. The frame section 14 has formed at a front end side thereof at least one retaining hole 141, preferably two as shown in FIGS. 2 and 4. In the embodiment illustrated and selectively, the frame section 14 comprises a fastener hole 142 formed thereon, preferably between the two retaining holes 141 as shown in the drawings, for receiving a screw (not shown) extending therethrough to be engageable with a threaded hole as may be provided oil the wall outlet 200. The threading engagement provided by the screw through the fastener hole 142 is not absolutely needed in practicing the present invention.

The frame section 14 may have provided at a rear end side thereof with at least ones but preferably two as shown, pivotal connector 15 which comprises a pivot 151.

Each of the conductor blades 20 that is received in the respective blade opening 131 of the receptacle 11 comprises a bent extension 21 corresponding to and positionable over the respective pad 13 of the base section 12 to conduct electricity from the wall outlet 200 into the night light 100.

A flat electro-luminescent light source 30 operating in accordance with the electro-luminescent principle that is capable to take the regular AC current from the regular wall outlets, is received within the receptacle 11 and is retained and fixed by the tabs 111 provided along the circumferential flange of the receptacle 11 so as not to shake or vibrate. The electro-luminescent light source 30 comprises a contact plate 31 on which a pair of pad-like electrical contact members or terminals 311 are provided to correspond to the bent extensions 21 of the conductor blades 20 and are positionable thereon to establish electrical connection therebetween for guiding electricity from the conductor blades 20 into the light source 30 to actuate the light source 30 to generate light. A pad 32 may be selectively added on the electric contact members 311 so as to make the overall thickness of the pads 13, the bent extensions 21 of the conductor blades 20, the electric contact members 311 of the light source 30 and the pad 32 substantially equal to the depth of the receptacle 11 at the base section 12 so that the base section 12 may completely accommodate the pads 13, the bent extensions 21 of the conductor blades 20, the electric contact members 311 of the light source 30 and the pad 32 therein.

A flat light-transmitting member 40 is sized to be receivable within the receptacle 11 and overlaying the light source 30 to allow the light generated by the light source 30 to transmit therethrough for emitting outward.

A cover 50 that has a shape corresponding to the front portion of the body 10 comprises an opening 51 to allow the light generated by the light source 30 to run therethrough and to fix to the front portion of the body 10 in such a manner that a distance present between the base section 12 of the receptacle 11 and the cover 50 is substantially equal to the overall thickness of the pads 13, the bent extensions 21 of the conductor blades 20 and the pad 32 so that fixing the cover 50 to the body 10 also firmly secures the pads 13, the conductor blades 20 and the pad 32 within the receptacle 11.

A shield 60 has a shape corresponding to the frame section 14 of the body 10, comprising at least one C-shaped retainers 62 at the rear end side thereof to rotatably receive and hold the pivot 151 of the at least one pivotal connector 15 provided on the frame section 14 therein for forming pivotal connection therebetween and thus allowing the shield 60 to be rotatable with respect to the frame section 14 between a closed position where the shield 60 cover and shield the frame section 14 and the passage 14A and an open position where the shield 60 is angularly away from the frame section 14 and thus exposing the passage 14A. The shield 16 comprises at least one hook 61 formed thereon and corresponding to and engageable with the at least one retaining hole 141 formed on the intermediate section of the body 10 so as to secure the shield 16 in the closed position to shield the frame section 15.

Preferably, recessed portions 63 may be provided on two sides of the shield 60 for finger gripping in rotating the shield 16 with respect to the frame section 15 between the closed position and the open position to shield and open the frame section 15.

Figure 3:
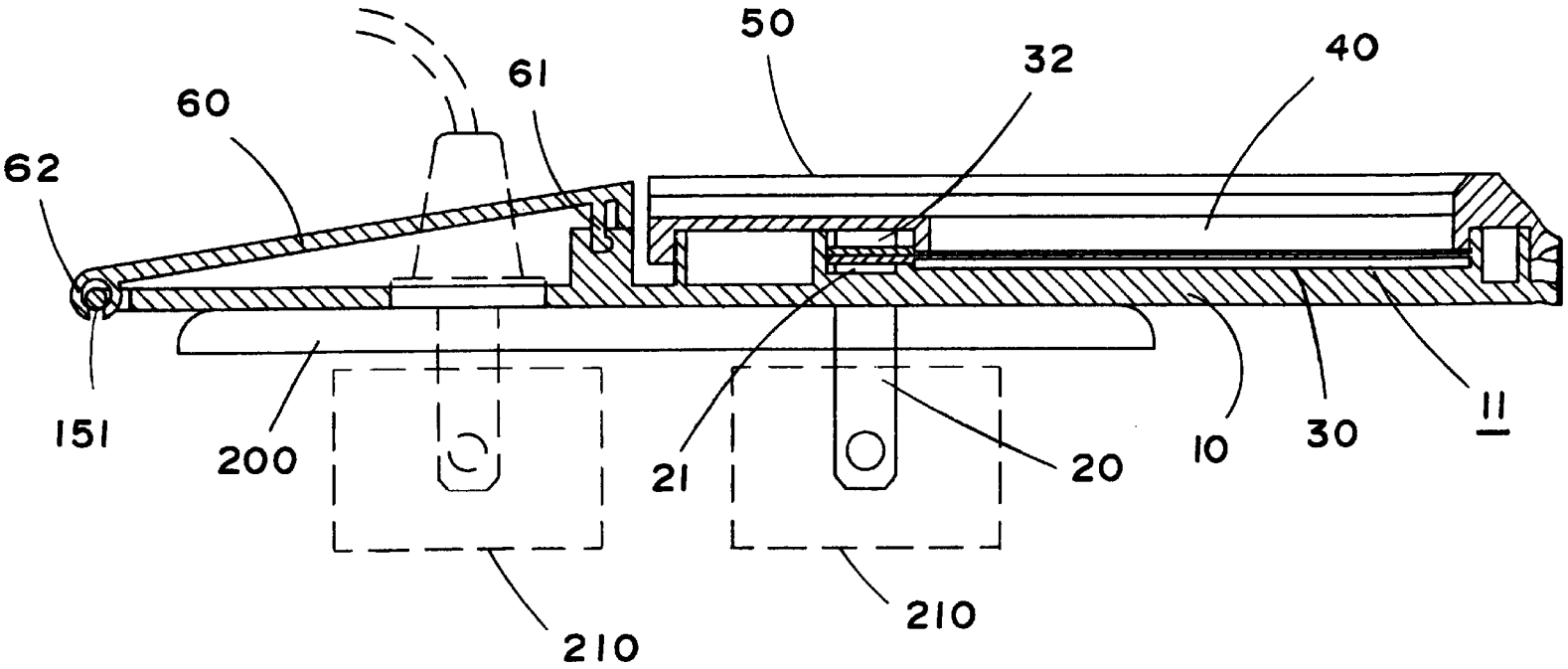
FIG. 3 is a cross-sectional view of the night light of the present invention.
Figure 4:
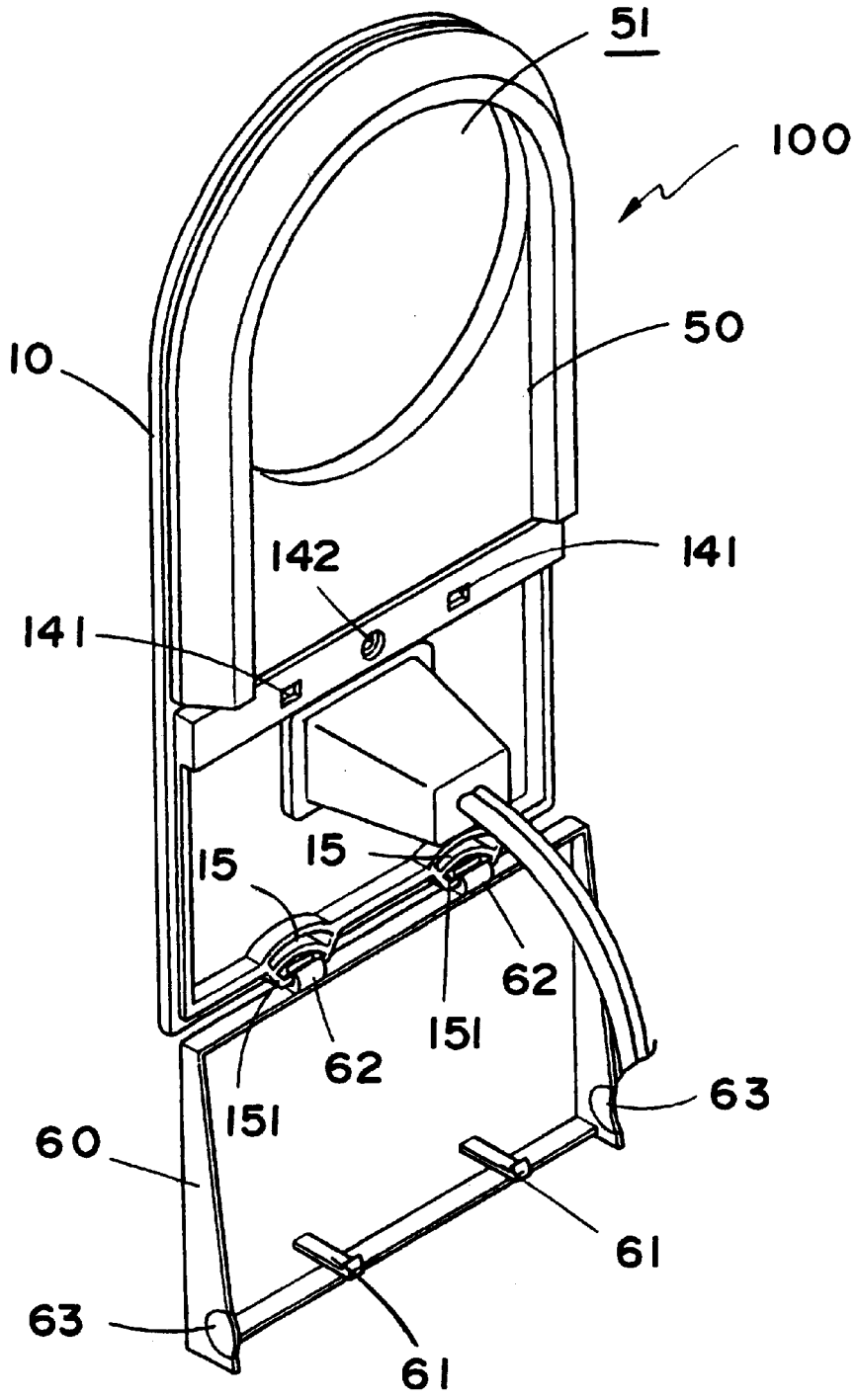
FIG. 4 is a perspective view of the night light of the present invention, with the shielding member opened to allow an external plug to connect to anther set of power outlet openings of the same wall outlet to which the night light is plugged.

With reference to FIGS. 3 and 4, the night light 100 of the present invention is designed to plug into one set of outlet openings of the wall outlet 200 in use by directly inserting the conductor blades 20 into the outlet openings to conduct electricity from the wall outlet 200 to the electro-luminescent light source 30 for actuating the light source 30. In a preferred embodiment in accordance with the present invention, the luminance of the night light 10 may be as high as 20 candle powers. As mentioned previously, the passage 14A formed on the frame section 15 of the body 10 is designed to substantially correspond to a second set of outlet openings of the wall outlet 200. This allows an external plug, such as a plug of another electrical appliance to connect to the second set of outlet openings of the wall outlet 200. This is done by opening the shield 60 to expose the frame section 14 and thus the passage 14A, as shown in FIG. 4. It should be noted that although in FIG. 3, an external plug is shown by phantom line as being plugged into the wall outlet 200 through the passage 14A yet it is shown only for demonstrating the relative position of the external plug with respect to the night light 100 and the wall outlet 200 and not to show that the external plug may connect to the wall outlet 200 without opening the shield 60. The second set of outlet openings (if any) of the wall outlet 200 may only be accessible by opening or removing the shield 60.

The flat configuration of the body 10, the light source 30 and the light-transmitting member 40 renders the night light 10 a flat article having a small thickness so as to allow the night light 10 of the present invention to be arranged very close to a wall or the wall outlet 200. This prevents or reduces the likelihood of accidental disengagement of the night light 10 from the wall outlet 200 by being impacted or contacted. Also, the shield 60 of the night light 10 reduces the chance of electrical shock causing by accidentally contacting the outlet openings of the wall outlet 200.

Although the present invention is illustrated by means of the preferred embodiment thereof, it is contemplated that there may be changes and modifications in the described embodiment that can be carried out without departing from the scope of the invention which is intended to be limited only by the appended claims.

What is claimed is:

1. A night light adapted to be connected to a first set of outlet openings of a wall outlet, comprising:

a body having a front portion with a receptacle formed thereon, the receptacle having a predetermined depth defined by a circumferential side wall, and a rear portion with a frame section formed thereon, the receptacle having a base section formed oil a rear end side of the receptacle with a pair of pads mounted therein, each associated with a blade opening formed through the base section, the frame section having a passage formed thereon adapted to align with a second set of outlet openings provided on the wall outlet, the frame section comprising at least one retaining hole formed on a front end side thereof and at least one pivotal connector having a pivot on a rear end side thereof;

a pair of conductor blades adapted to be inserted into the first set of outlet openings of the wall outlet to establish electrical connection therewith, each having a bent extension and being receivable within each of the blade openings of the base section of the receptacle to have the bent extension substantially corresponding to and positionable against the respective one of the pads on the base section of the receptacle;

an electro-luminescent light source of a flat configuration, disposed in the predetermined depth of the receptacle, having a contact plate extending therefrom to support a pair of electrical contact members which are positionable over and in electrical engagement with the bent extensions of the conductor blades to receive electricity therefrom for actuating the light source to generate light;

a flat light-transmitting member, sized to be receivable within the depth of the receptacle and to overlap the light source to allow the light generated by the light source to transmit therethrough and emit outward;

a cover having an opening corresponding to the light-transmitting member to allow the light that transmits through the light-transmitting member to project therethrough and to secure the cover to the front portion of the body; and a shield comprising at least one connection element corresponding to and rotatably engageable with the at least one pivot of the frame section to render the shield rotatable relative to the frame section between an open position where the shield is angularly away from the frame section to expose the passage of the frame section and a closed position where the shield substantially covers the frame section and thus shields the passage of the frame section, the shield comprising at least one hook releasably engageable with the at least one of the retaining hole of the frame section to releasably secure the shield in the closed position.

2. The night light as claimed in claim 1, wherein the circumferential side wall of the receptacle comprises a plurality of retaining tabs formed thereon for retaining the light source therein.

3. The night light as claimed in claim 2, wherein the retaining tabs have a triangular shape.

4. The night light as claimed in claim 1, wherein the body further comprises a screw hole corresponding in position to a threaded hole provided on the wall outlet to allow the night light to be secured to the wall outlet by means of a screw extending through the screw hole and engaging the threaded hole of the wall outlet.

5. The night light as claimed in claim 1, wherein a further pad is interposed between the contact plate of the light source and the cover to more firmly hold the light source inside the receptacle.

6. The night light as claimed in claim 1, wherein the shield comprises two recessed portions on two opposite sides thereof for finger gripping.

7. The night light as claimed in claim 1, wherein the frame section comprises two retaining holes.

8. The night light as claimed in claim 1, wherein the frame section comprises two pivotal connectors.

* * * * *